United States Patent [19]

Sandvick

[11] Patent Number: 4,763,380

[45] Date of Patent: Aug. 16, 1988

[54] CAN CLEANING DEVICE

[76] Inventor: Warren J. Sandvick, Rt. 11, Box 125 A-38, Lubbock, Tex. 79407

[21] Appl. No.: 97,151

[22] Filed: Sep. 16, 1987

[51] Int. Cl.[4] ..... A46B 9/02

[52] U.S. Cl. ..... 15/160; 15/70; 15/104.04; D4/130

[58] Field of Search ..... 15/160, 164, 65, 67, 15/56, 70, 21 A, 180, 104.011, 104.012, 104.03, 104.04, 104.02; D4/127, 130, 137; D32/40, 46

[56] References Cited

U.S. PATENT DOCUMENTS

| | | | |
|---|---|---|---|
| 490,682 | 1/1893 | Roemer | 15/191 R |
| 601,405 | 3/1898 | Shepherd | 15/191 R |
| 1,006,630 | 10/1911 | Clarke | 15/188 |
| 1,362,822 | 12/1920 | Rude | 15/70 |
| 2,682,675 | 7/1954 | Prucha | 15/180 X |
| 4,683,603 | 8/1987 | Purlia et al. | 15/160 X |
| 4,733,423 | 3/1988 | Blatt | 15/160 |

FOREIGN PATENT DOCUMENTS

| | | | |
|---|---|---|---|
| 708183 | 4/1954 | United Kingdom | 15/180 |

*Primary Examiner*—Peter Feldman
*Attorney, Agent, or Firm*—Jerry T. Kearns

[57] ABSTRACT

A device for cleaning the top surface of beverage cans is formed from a circular disk provided with symmetrical openings and has a plurality of bristles extending downwardly from a bottom surface thereof. A cylindrical sidewall surrounds the bristles and a bottom circular edge of the cylindrical sidewall extends downwardly past the ends of the bristles. First and second radially spaced circular brush portions are formed of a diameter to engage the gutters formed on two different standard beverage cans. Radially extending brush portions are positioned to clean the flat top surface of beverage containers. In use, the circular plate is placed on top of a beverage can, with the bristles extending downwardly and engaging the top surface of the beverage can. Water is then allowed to run through the openings, while the circular plate is rotated back and forth with the bristles in engagement with the beverage can. This results in a thorough cleaning of the top surface of the beverage can.

1 Claim, 2 Drawing Sheets

CAN CLEANING DEVICE

BACKGROUND OF THE INVENTION

1. Field of the Invention

The present invention relates to can cleaning devices, and more particularly pertains to a new and improved can cleaning device designed for use with beverage cans. A wide variety of beverages such as sodas and beer are sold in cylindrical beverage cans. These cans have a top surface provided with a removable closure for accessing the contents of the can. The contents of the can are frequently consumed directly from the can, without being poured into a secondary glass or cup. Due to the handling and storage of these beverage cans, the top surface of the cans frequently becomes dusty or contaminated with foreign substances. As the top surface of the beverage can will come into contact with the mouth of a consumer, it is the object of the present invention to provide a device for cleaning the top surface of a beverage can before use.

2. Description of the Prior Art

Various types of can cleaning devices are known in the prior art. A typical example of such a can cleaning device is to be found in U.S. Pat. No. 279,222, which issued to F. Cass on June 12, 1883. This patent discloses a machine for scouring and polishing tin cans and boxes by the use of reciprocable brushes. Two pairs of brushes are arranged at right angles to one another for engaging the sides of a square can or box. The device is a large and complicated mechanism. U.S. Pat. No. 282,434, which issued to V. Barker on July 31, 1883, discloses a can washing machine for cleaning the tops of filled and uncapped cans. The device utilizes a gear driven scraper head in conjunction with a water supply. U.S. Pat. No. 413,168, which issued to C. Burt on Oct. 22, 1889, discloses a machine for wiping cans for cleaning the tops of the cans prior to the soldering of the caps. The device utilizes a rotary brush in conjuction with a water supply. U.S. Pat. No. 416,212, which issued to P. Cummings on Dec. 3, 1889, discloses a can wiping machine which utilizes flexible ribbed wiping rolls for wiping the top surface of a can. The wiping rolls are rotated by a belt and pulley arrangement. U.S. Pat. No. 3,264,675, which issued to R. Di Ilio on Aug. 9, 1966, discloses a device for cleaning and washing cans and similar containers. The device utilizes a portable container for the storage and heating of a cleaning fluid which is dispensed through a cleaning head provided with brushes.

While the above mentioned devices are suited for their intended usage, none of these devices provides a portable hand manipulated brush for cleaning the top surfaces of beverage cans. Further, none of the aforementioned devices are of a size to be conveniently carried in the pocket of a user. Additionally, none of the previously mentioned can cleaning devices utilizes a cleaning head provided with bristles designed for use with two different standard beverage can configurations. Inasmuch as the art is relatively crowded with respect to these various types of can cleaning devices, it can be appreciated that there is a continuing need for and interest in improvements to such can cleaning devices, and in this respect, the present invention addresses this need and interest.

SUMMARY OF THE INVENTION

In view of the foregoing disadvantages inherent in the known types of can cleaning devices now present in the prior art, the present invention provides an improved can cleaning device. As such, the general purpose of the present invention, which will be described subsequently in greater detail, is to provide a new and improved can cleaning device which has all the advantages of the prior art can cleaning devices and none of the disadvantages.

To attain this, representative embodiments of the concepts of the present invention are illustrated in the drawings and make use of a flat circular plate provided with four radially extending symmetrical tapered openings. The plate has a downwardly extending cylindrical sidewall which encloses a plurality of bristles which extend downwardly from a bottom surface of the circular plate. The present invention also utilizes two radially spaced circular brush portions, each designed for engagement with beverage can rim gutters of two different standard configurations.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved can cleaning device which has all the advantages of the prior art can cleaning devices and none of the disadvantages.

It is another object of the present invention to provide a new and improved can cleaning device which may be easily and efficiently manufactured and marketed.

It is a further object of the present invention to provide a new and improved can cleaning device which is of a durable and reliable construction.

An even further object of the present invention is to provide a new and improved can cleaning device which is susceptible of a low cost of manufacture with regard to both materials and labor, and which accordingly is then susceptible of low prices of sale to the consuming public, thereby making such can cleaning devices economically available to the buying public.

Still yet another object of the present invention is to provide a new and improved can cleaning device which provides in the apparatuses and methods of the prior art some of the advantages thereof, while simultaneously overcoming some of the disadvantages normally associated therewith.

Still another object of the present invention is to provide a new and improved can cleaning device for use with beverage cans, that is easily portable and manually usable.

Yet another object of the present invention is to provide a new and improved can cleaning device designed for use with two different standard beverage can configurations.

Even still another object of the present invention is to provide a new and improved can cleaning device which utilizes a circular plate provided with downwardly extending bristles and a plurality of openings for the passage of cleaning water.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when considèration is given to the following detailed description thereof. Such description makes reference to the annexed drawings wherein.

DESCRIPTION OF THE PREFERRED EMBODIMENT

Figure 1:
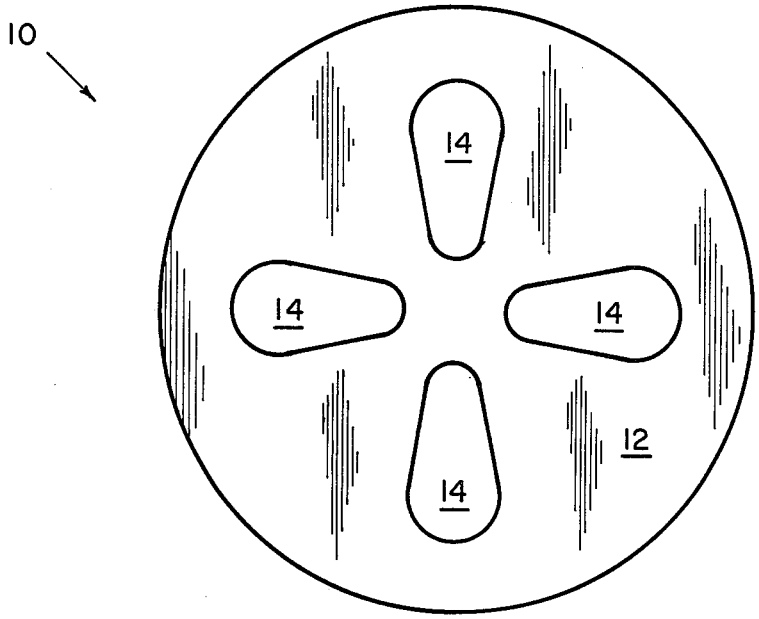
FIG. 1 is a top plan view of a can cleaning device of the present invention.

With reference now to the drawings, and in particular to FIG. 1 thereof, a new and improved can cleaning device embodying the principles and concepts of the present invention and generally designated by the reference numeral 10 will be described.

More specifically, it will be noted that the first embodiment 10 of the invention includes a flat circular base plate 12 having four radially extending symmetrical tapered openings 14. It will be noted that each of the openings 14 is formed with a radius at opposed end walls. It will be further noted that each opening tapers in width from a narrow radially inner end to a wide radially outer end. The purpose of this configuration will be subsequently described.

Figure 2:
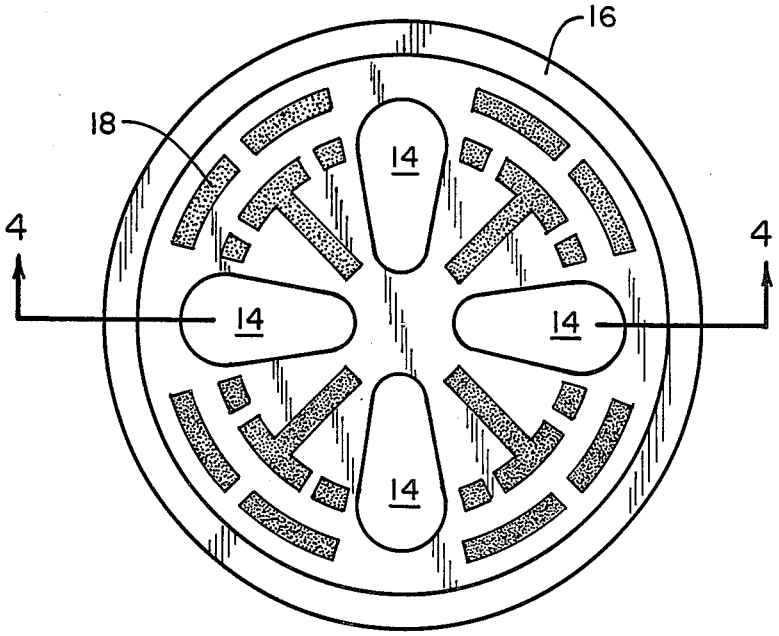
FIG. 2 is a bottom plan view of the can cleaning device of the present invention.

With reference now to FIG. 2, it may be seen that a plurality of bristles 18 extend downwardly from the bottom surface of the circular plate 12. The bristles 18 are arranged to form radially outer and radially inner circular brush portions. The bristles 18 also form four radially extending brush portions symmetrically positioned between each of the openings 14. The function of each of these brush portions will be described subsequently. It should also be noted that a downwardly extending cylindrical sidewall is formed on the circular support plate 12, the bottom end 16 of which is depicted in FIG. 2.

Figure 3:
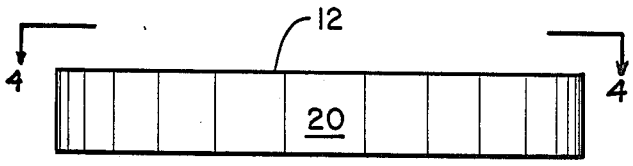
FIG. 3 is a side view of the can cleaning device of the present invention.

With reference now to FIG. 3, a side view of the can cleaning device of FIG. 1 is illustrated. The cylindrical downwardly extending sidewall 20 is clearly shown.

Figure 4:
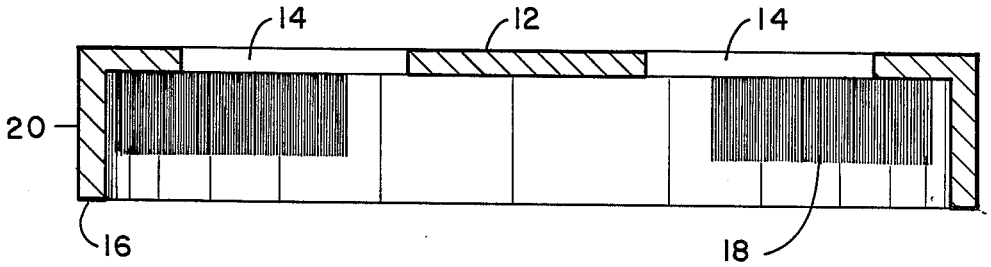
FIG. 4 is a cross sectional view of the can cleaning device of the present invention, taken along lines 4—4 of FIG. 3.

With reference now to FIG. 4, a cross sectional view of the can cleaning device 10 of the present invention is illustrated. It will be noted that the cylindrical sidewall 20 extends downwardly to an extent greater than bristles 18 and thus the end wall 16 of the sidewall 20 is positioned beneath the lower ends of the bristles 18. The cylindrical sidewall 20 is configured so as to surround the bristles 18.

With reference now to FIG. 1, the manner of usage of the can cleaning device 10 of the present invention will now be described. The circular support plate 12 is placed over the top end of a beverage can to be cleaned with the bristles 18 extending downwardly and engaging the top surface of the can. With reference now to FIG. 2, it will be apparent that the cylindrical sidewall 20 is placed over the top of the can and extends downwardly along the sides of the can. In this condition, the beverage can with the can cleaning device 10 positioned thereon is placed under a source of clean water, such as a sink, faucet or drinking fountain. Water is then allowed to run on the top surface of the support plate 12 and through the openings 14. The beverage can is held in one hand while the circular support plate 12 is rotated back and forth by the other hand. This results in a scrubbing of the top surface of the can by the bristles 18. The radially outer circular brush portion formed by bristles 18 is of a diameter to be received in the top can gutter which is formed on the type of beverage cans in which SHASTA products are marketed. The radially inner circular brush portion formed by bristles 18 is dimensioned to engage the top can gutter of beverage cans of the configuration in which PEPSI and COKE products are marketed. Thus it may be seen that the can cleaning device of the present invention is suitable, without alteration, for use with two different standard beverage cans. It will also be noted that the taper of the openings 14 serves to distribute the majority of applied cleaning water to the radially outer brush portions, thus providing a quantity of water adequate to flush out the top gutter portion of a beverage can. The four radially extending brush portions positioned between the openings 14 serve to scrub the top flat surface of a beverage can. When not in use, the can cleaning device of the present invention is of a size which may be easily carried in a pocket or purse of the user, thus ensuring that the device will always be available.

The circular plate 12 and downwardly extending sidewall 20 may be formed either of a metal or plastic, and the bristles 18 are preferably formed of a synthetic material such as nylon or high molecular weight polyethylene, although of course natural bristles may also be utilized.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved can cleaning device, comprising:

a circular plate having a diameter slightly larger than a can to be cleaned;

a downwardly extending cylindrical sidewall formed on said circular plate;

four radially extending openings symmetrically formed through said circular plate;

each of said openings tapering in width from a narrow radially inner end adjacent a central portion of said circular plate to a wider radially outer end adjacent an outer edge portion of said circular plate;

each of said openings having opposed radiused inner and outer end walls;

a plurality of bristles extending downwardly from a bottom surface of said circular plate;

said cylindrical sidewall surrounding said bristles and a circular bottom edge of said cylindrical sidewall extending downwardly beyond the extent of said bristles;

said bristles forming a first generally circular radially outer brush portion composed of circumferentially spaced discrete arcuate segments dimensioned for engagement in a gutter formed on a top surface of a first standard size beverage can and a second, radially spaced, generally circular radially inner brush portion composed of circumferentially spaced discrete arcuate segments dimensioned for engagement in a gutter formed on a top surface of a second standard size beverage can; and said bristles also forming four radially extending circumferentially spaced brush portions symmetrically disposed between said four radially extending openings.

* * * * *